US009623319B2

(12) United States Patent
Miller

(10) Patent No.: US 9,623,319 B2
(45) Date of Patent: Apr. 18, 2017

(54) GAMES PLAYED WITH ROBOTS

(71) Applicant: Kenneth C. Miller, Aptos, CA (US)

(72) Inventor: Kenneth C. Miller, Aptos, CA (US)

( * ) Notice: Subject to any disclaimer, the term of this patent is extended or adjusted under 35 U.S.C. 154(b) by 240 days.

(21) Appl. No.: 14/051,309

(22) Filed: Oct. 10, 2013

(65) Prior Publication Data

US 2014/0100012 A1 Apr. 10, 2014

Related U.S. Application Data

(60) Provisional application No. 61/712,083, filed on Oct. 10, 2012, provisional application No. 61/870,480, filed on Aug. 27, 2013.

(51) Int. Cl.

| | |
|---|---|
| ***A63F 9/24*** | (2006.01) |
| ***A63F 7/00*** | (2006.01) |
| ***A63F 7/30*** | (2006.01) |

(52) U.S. Cl.

CPC ..... *A63F 9/24* (2013.01); *A63F 7/0023* (2013.01); *A63F 7/0058* (2013.01); *A63F 7/307* (2013.01); *A63F 2007/0047* (2013.01); *A63F 2009/2442* (2013.01); *A63F 2009/2489* (2013.01)

(58) Field of Classification Search

CPC ..... A63F 9/24
USPC ..... 463/9
See application file for complete search history.

(56) References Cited

U.S. PATENT DOCUMENTS

| | | | | |
|---|---|---|---|---|
| 6,674,259 | B1 * | 1/2004 | Norman | A63H 11/00 318/567 |
| 7,831,337 | B2 | 11/2010 | Greenspan | |
| 7,893,646 | B2 | 2/2011 | Yourlo et al. | |
| 7,974,738 | B2 | 7/2011 | Bruemmer et al. | |
| 8,073,564 | B2 | 12/2011 | Bruemmer et al. | |
| 8,246,050 | B2 | 8/2012 | Do et al. | |
| 8,292,733 | B2 | 10/2012 | Crawford et al. | |
| 2002/0137427 | A1 * | 9/2002 | Peters | A63H 30/04 446/454 |
| 2003/0208304 | A1 * | 11/2003 | Peless et al. | 700/245 |
| 2003/0232649 | A1 * | 12/2003 | Gizis et al. | 463/40 |
| 2006/0063599 | A1 * | 3/2006 | Greenspan | B25J 9/1697 473/1 |
| 2006/0223637 | A1 * | 10/2006 | Rosenberg | 463/47 |

(Continued)

FOREIGN PATENT DOCUMENTS

| | | | |
|---|---|---|---|
| JP | 2009039181 | A | 2/2009 |
| KR | 102002033303 | A | 5/2002 |

(Continued)

OTHER PUBLICATIONS

Angel Osorno and Brandan Sackett "Hustler's, Inc., Electronic Pool Scoring System" Final Design Report., pp. 1-9.

Sara Mitri et al. "Fast Color-Independent Ball Detection for Mobile Robots", Fraunhofer Institute for Autonomous Intelligent Systems (AIS), Schloss Birlinghoven, D-53754 Sankt Augustin, Germany, {firstname.surname}@ais.fraunhofer.de; 6 pages.

(Continued)

*Primary Examiner* — Omkar Deodhar
*Assistant Examiner* — Shauna-Kay Hall
(74) *Attorney, Agent, or Firm* — Avery N. Goldstein; Blue Filament Law PLLC

(57) ABSTRACT

A robotic gaming system is provided that includes at least one sensor placed on a playing surface. At least one robot is controlled by a player to navigate on the playing surface and manipulate at least one target towards a gate. The sensor is operative for identifying when the target is moved to a scoring region of the playing surface.

17 Claims, 9 Drawing Sheets

(56) References Cited

U.S. PATENT DOCUMENTS

| | | | | |
|---|---|---|---|---|
| 2006/0252340 | A1* | 11/2006 | Bach | G09B 23/10 446/124 |
| 2009/0081923 | A1* | 3/2009 | Dooley et al. | 446/456 |
| 2009/0170602 | A1* | 7/2009 | Martin | G07F 17/3227 463/39 |
| 2009/0248200 | A1* | 10/2009 | Root | B25J 9/1689 700/245 |
| 2010/0013153 | A1 | 1/2010 | Yourlo et al. | |
| 2010/0042258 | A1 | 2/2010 | Perlin et al. | |
| 2010/0178994 | A1* | 7/2010 | Do | A63D 15/006 473/2 |
| 2010/0283883 | A1 | 11/2010 | Sato et al. | |
| 2011/0054689 | A1 | 3/2011 | Nielsen et al. | |
| 2011/0065520 | A1* | 3/2011 | Morris | A63D 15/00 473/2 |
| 2012/0208150 | A1 | 8/2012 | Spychaiski | |
| 2012/0238366 | A1* | 9/2012 | Tedder | A63H 30/04 463/42 |

FOREIGN PATENT DOCUMENTS

| | | | | |
|---|---|---|---|---|
| KR | 2020100011328 | U | 11/2010 | |
| KR | 2020110005089 | U | 5/2011 | |
| WO | WO 2010000068 | A1 * | 1/2010 | A63D 15/00 |

OTHER PUBLICATIONS http://www.gosphero.com/.
http://drgraeme.net/drgraeme-free-nxt-g-tutorials/Ch108/SoccerGenIINXTG/Soccer Ball/SoccerBall.htm.
http://www.okanagan.bc.ca/programs/areas_of_study/engineeringtechnologies/robocup/soccer_challenge.html.
http://www.robocup2011.org/en.
http://www.dezeen.com/2013/10/07/ctrus-football-by-agent.
http://www.dailymail.co.uk/sciencetech/article-2169176/Goal-line-technology-finally-signed-Premiership.html.
http://www.robotex.ee/eng/node/364.

* cited by examiner

GAMES PLAYED WITH ROBOTS

RELATED APPLICATIONS

This application is a non-provisional application that claims priority benefit of U.S. Provisional Application Ser. No. 61/712,083 filed Oct. 10, 2012; and U.S. Provisional Application Ser. No. 61/870,480 filed Aug. 27, 2013; the contents of these provisional applications are hereby incorporated by reference.

FIELD OF THE INVENTION

The present invention in general relates to entertainment and games, and in particular to a mass-produced robotic game for the general public.

BACKGROUND OF THE INVENTION

Most robot games are intended for the robots to push each other around (sumo), destroy each other (e.g., BattleBots, RoboWars, etc.), or play some form of soccer (push/roll/kick a ball into a goal). In addition, some robot games are designed for a specific purpose for hobbyists and educational competitions (e.g., First, etc.). In a particular game played on a pool or billiard table surface, competing robots are used to score points by pushing or knocking pool balls into the table pockets. A traditional billiard or pool table has six pockets for aiming at and targeting pool balls, with four pockets positioned at the corners of the table, and two pockets positioned at each of the midpoints of the table lengthwise sides. However, there are currently no automated methods for identifying when and which balls fall into which pockets of a billiard table.

Thus, there exists a need for mass-produced robotic games for the general public. There also exists a need for an automated method and system for identifying when and which balls fall into which pockets.

SUMMARY OF THE INVENTION

A robotic gaming system is provided that includes at least one sensor placed on a playing surface. At least one robot is controlled by a player to navigate on the playing surface and manipulate at least one target towards a gate. The sensor is operative for identifying when the target is moved to a scoring region of the playing surface. A robotic game is also provided that includes a plurality of master robots, each of the master robots uniquely assigned to a player. One or more slave targets is uniquely assigned to each of the master robots. A controller is assigned to each player for interactive control of an assigned master robot and corresponding slave targets on a playing surface. The game concludes when all of the slave targets of competing players have been eliminated from the playing surface.

A process for playing a robotic game includes electronically coupling at least one first competitor slave target, each of the at least one first competitor slave target having intelligence to a first competitor master robot. At least one second competitor slave target is coupled thereto and having intelligence to a second competitor master robot. The at least one first competitor slave target, the at least one second competitor, the first competitor master robot, and the second competitor master robot and placed onto a playing field. Functionality of the first competitor master robot is reduced when the at least one first competitor slave target is removed from the playing field alone or in combination with reducing or eliminating functionality of the second competitor master robot when the at least one second competitor slave target is removed from the playing field.

DETAILED DESCRIPTION OF THE INVENTION

The present invention has utility as a robotic game that integrates the functions of robots with portable electronics, such as smart phones. Embodiments of the robotic game provide matched sets of a single "master" robot and multiple "slave" targets to play a game that is similar to last combatant standing games such as "Cut Throat" (three person pool game). In an embodiment of the robotic game, when the targets of a master robot are eliminated from the game, the master robot is caused to have reduced functionality (such as motion stop), and the winner is the last one to have functioning (living) slave targets.

In another embodiment, the present invention has utility as an automated method and system for identifying when and which pool balls fall into which pockets of a billiard table. The identification of a pool ball in a pocket may be used for scoring traditional games of pocket billiards, or for scoring robotic based games played on the surface of the billiard table. For example, the numeric values printed on the face of the pool balls may be added to determine a winner of a game based on a total score of values of those balls knocked in by a player by themselves or by controlling a robot.

Figure 1:
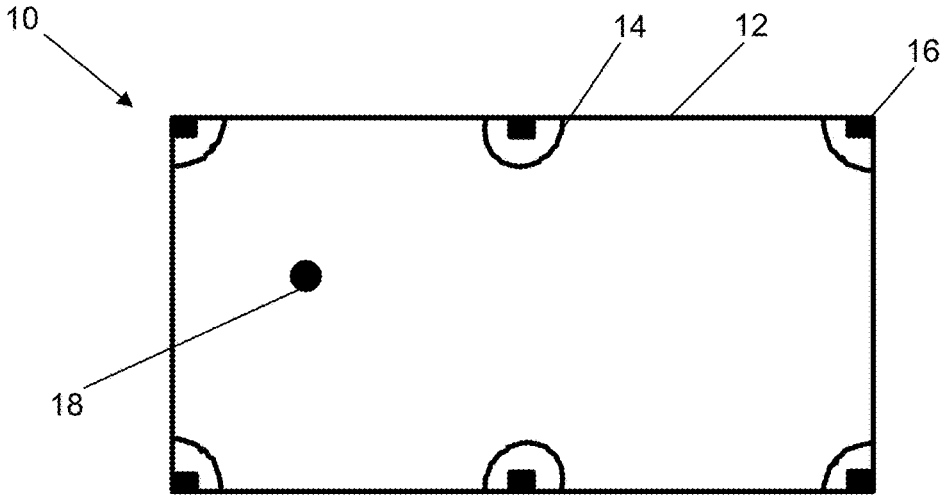
FIG. 1 is a top down view of a billiard table with identification and tracking sensors positioned in the table pockets according to embodiments of the invention.

As seen in FIG. 1, a system is shown generally at 10, defined by a wall 12 and having sidewall gate 14 and a corner gate 16, each having a sensor. The sensors in each instance are independently a camera, an electric eye, and RFID antennae, a force sensor, or an inductive sensor, or a combination thereof. For the purposes of explaining various embodiments of the present invention a "pocket" of a billiards-like playing surface and a "gate" of an opening above the plane of the playing surface for receiving a "target" are used synonymously. Similarly, a ball is defined herein as a subset of various targets that are moved in the present invention game by a robot. It is appreciated a single robot can be used to play a timed game relative to a competitor, or multiple robots simultaneously compete to move targets on the playing surface.

Figure 2:
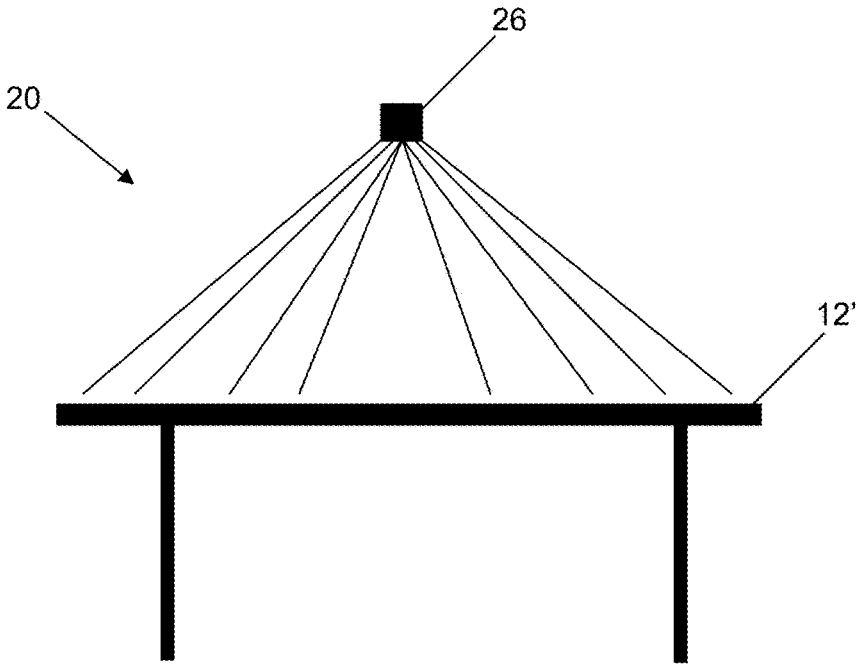
FIG. 2 is a side perspective drawing showing a billiard table with an identification and tracking sensor suspended above the table according to embodiments of the invention.

In FIG. 2 a system is shown generally at 20, an overhead sensor 26 observes targets on the playing surface 12'. It is appreciated that the playing surface 12' is like that of FIG. 1, or has alternative shapes, non-planar topography, obstacles, or combinations thereof.

By way of example, a video camera is present as a sensor 26 and mounted above the playing surface for implementing: vision system software to track spherical (pool ball) targets going into pockets of pool table, and for broadcasting video of the game so the game can be played remotely and for instant replay. A laser system in some embodiments is mounted above the playing surface for indicating lines on the playing surface for play of cues and balls.

Figure 3A:
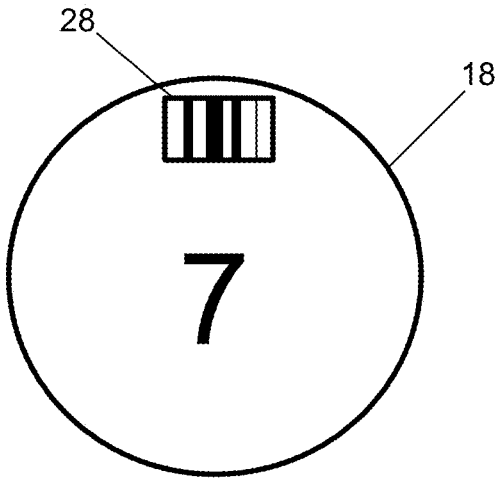
FIG. 3A is a side perspective view of a pool ball with an identification barcode according to embodiments of the invention.

In some embodiments, a sensor 14, 16, or 26 tracks and identify individual targets with character recognition of the number printed on the balls surface (e.g. numbered 1 through 15 with no change to the existing pool balls appearances) when they go into any of the pockets (assigned numbers 1 through 6). Alternatively, each of the pool balls have unique machine readable (vision) markings 28 (in addition to the standard markings of numbers, colors and stripes) for each ball 18 (1 through 15) that are operative with the identification vision system as shown in FIG. 3A. Markings 28 may include barcodes, quick response (QR) codes, or other coded representations of numbers.

Figure 3B:
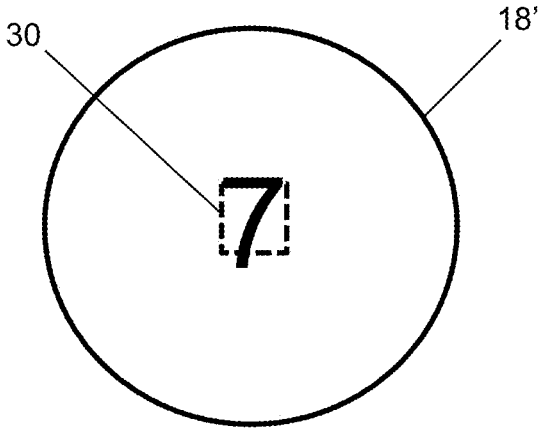
FIG. 3B is a side perspective view of a pool ball with a unique machine readable or recognizable electronics/component (RFID, magnets, etc.) embedded inside according to embodiments of the invention.

In an alternative embodiment of the inventive pool ball identification system, each of pool balls 18' may have a unique machine readable or recognizable electronics/components (RFID, magnets, etc.) embedded inside each ball (1 through 15) 30, as shown in FIG. 3B. Sensors operative to read and determine the type (number value) based on the radio frequency identification (RFID), magnet, or other electronic embedded components, may be positioned at each of the pockets. Alternatively, a sensor system may be placed on, around, under, or above the table that can track and identify individual balls (1 through 15) when they go into any pocket (1 through 6).

Figure 4:
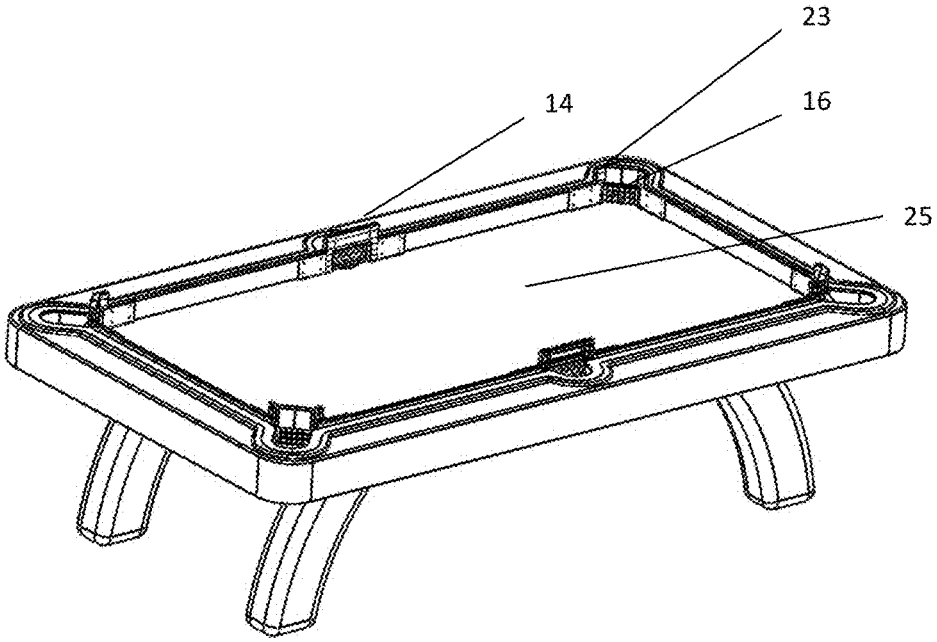
FIG. 4 is an elevated perspective view of playing table for inventive games.

In an embodiment of the inventive gaming system, a playing surface mat embedded with tracking and identification sensors 14 or 16 with such sensors mounted on gate-like goals 23, as shown in FIG. 4, where like numerals correspond to the meanings assigned thereto with respect to previously detailed drawings. The mat 25 in some embodiments retrofits onto a conventional billiards table and may be used to track the balls. The mat 25 may have a plain felt like finish, as found on billiard tables, without any markings, or may have markings related to a game, such as a robotic game with graphics and indicators for positioning game pieces before play begins (and to protect pool table felt). In some inventive embodiments, the mat 25 may have Intelligence to monitor game pieces, and/or electronic graphics for visual stimulation of the players and audience. The mat 25 may also be rolled up in some embodiments to promote transport and storage.

Figure 5:
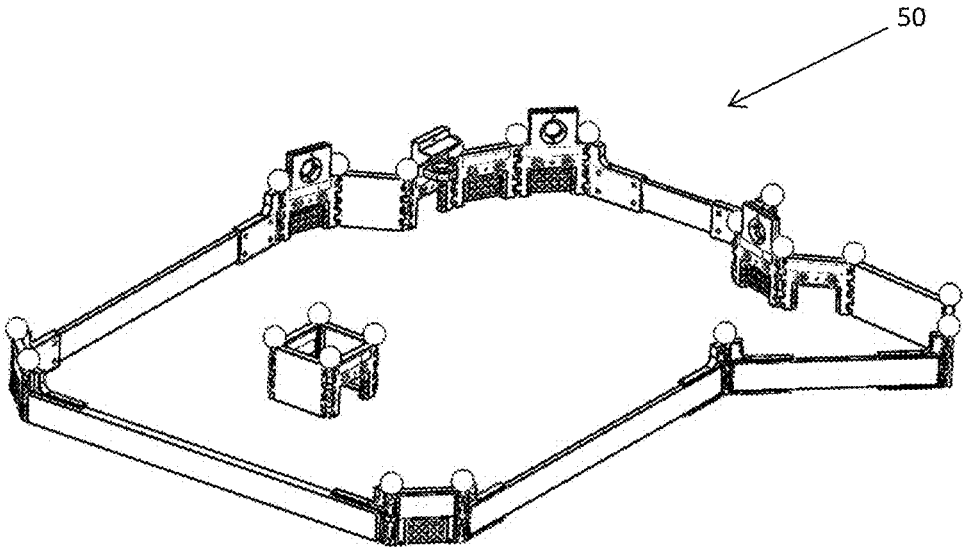
FIG. 5 is an alternative construct of a playing area for an inventive game.
Figure 6A:
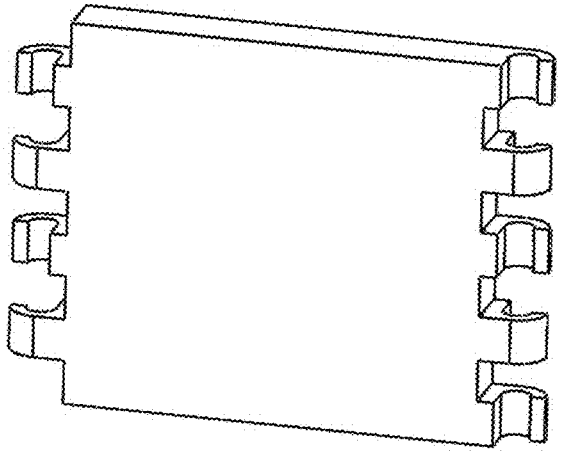
FIGS. 6A-6E are perspective images of a wall section (FIG. 6A), various gate sections (FIGS. 6B-6D) and a pin (FIG. 6E) for joining the aforementioned sections together.
Figure 6B:
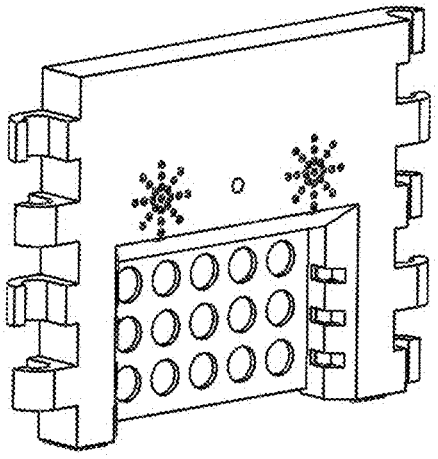
Figure 6C:
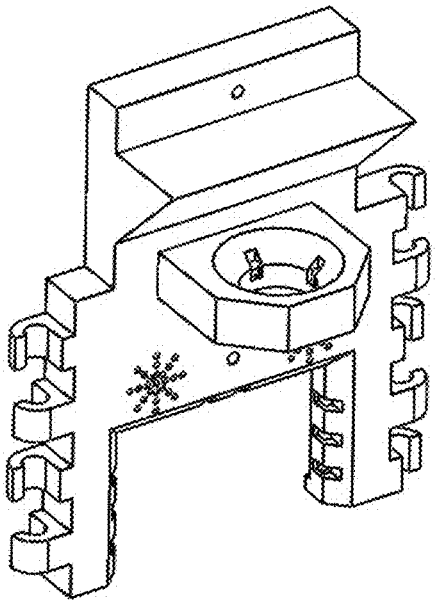
Figure 6D:
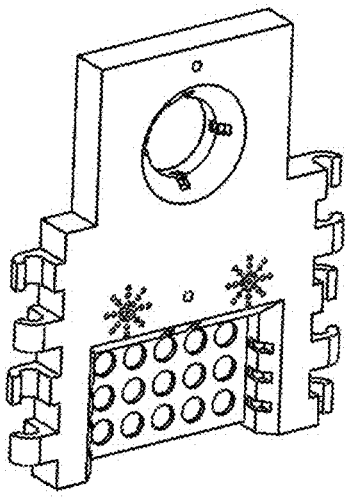
Figure 6E:
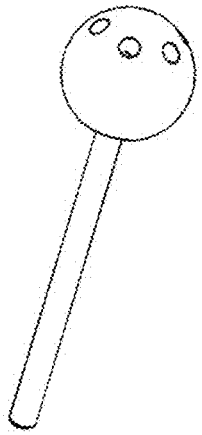

A de novo playing surface is also constructed in user selected configurations based on modular components and is shown generally at 50 in FIG. 5. The playing surface 50 is readily bounded with wall sections (FIG. 6A), gate sections (FIGS. 6B-6D) and pins (FIG. 6E). Sensors 14 or 16 per FIG. 1 are present in gate sections ((FIGS. 6B-6D). It is appreciated that a gate section is used in certain inventive embodiments as having a thresholding function to, for example, replenish munitions in those variants of the invention in which a weapon is present on a robot, or as a battery recharge station for a robot.

Figure 7:
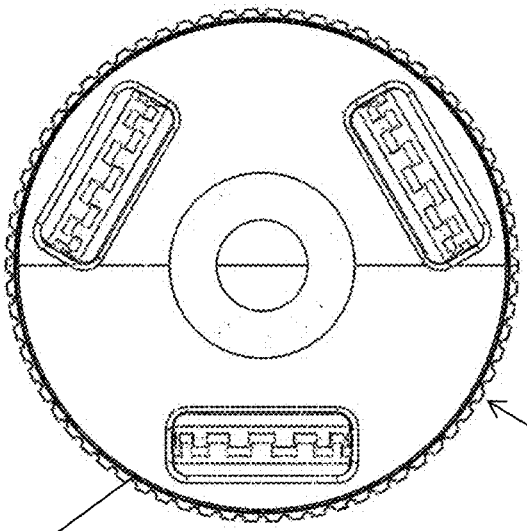
FIG. 7 is a side view of an embodiment of a robot operative in the present invention.
Figure 8:
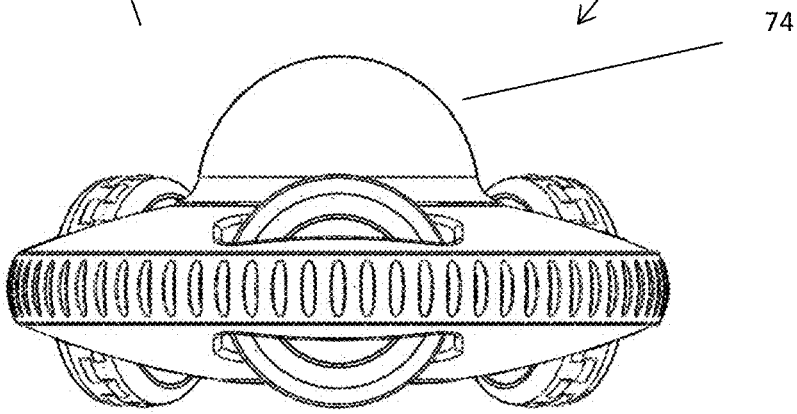
FIG. 8 is a bottom view of the robot shown in FIG. 7.

An exemplary robot of operation in an inventive game is shown generally at 70 in FIGS. 7 and 8. The robot 70 is characterized by at least one drive wheel 72 and an ability to steer the robot 70. In a preferred embodiment an application program operating on a smart phone or tablet device controls the movement of the robot 70. A weapon 74 is provided in some embodiments to impede the activities of a competitive robot from moving targets 18. As noted above the sensor used in the robots would be operative to recognize targets 18 with unique machine readable or recognizable electronics/components (RFID, magnets, etc.) inside each ball (1 through 15), or machine readable (vision) unique marks (in addition to the standard markings of numbers, colors and stripes) for each ball (1 through 15), or the markings and colors (stripes and solids and numbers 1 through 15) on a typical set of pool balls.

Figure 9:
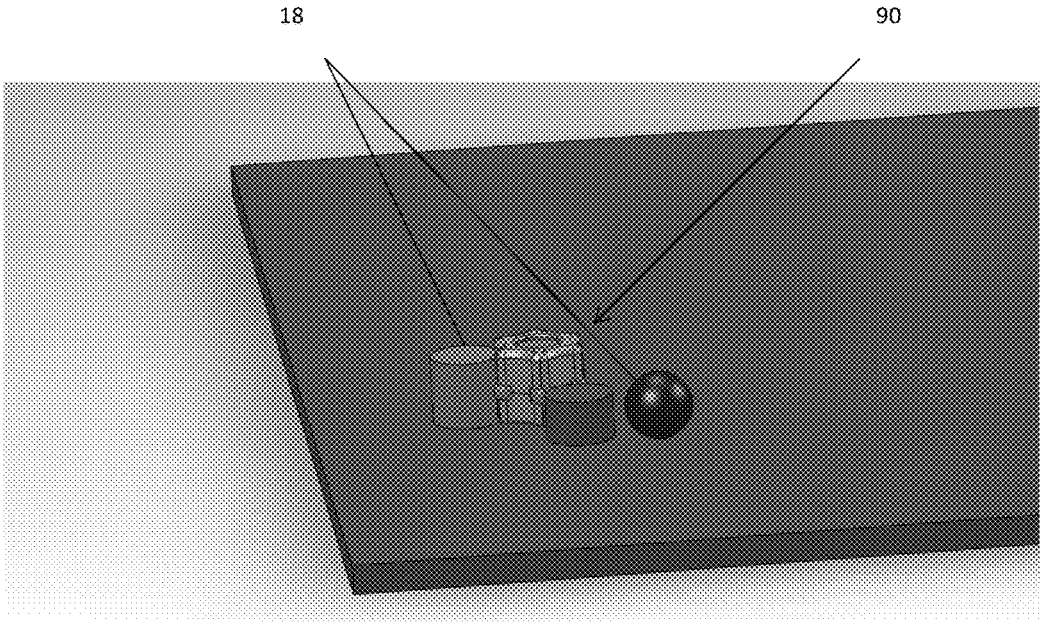
FIG. 9 is a perspective view of another embodiment of robot operative in the present invention and depicted in the context of a playing field and various targets of a ball and cylinders.
Figure 10:
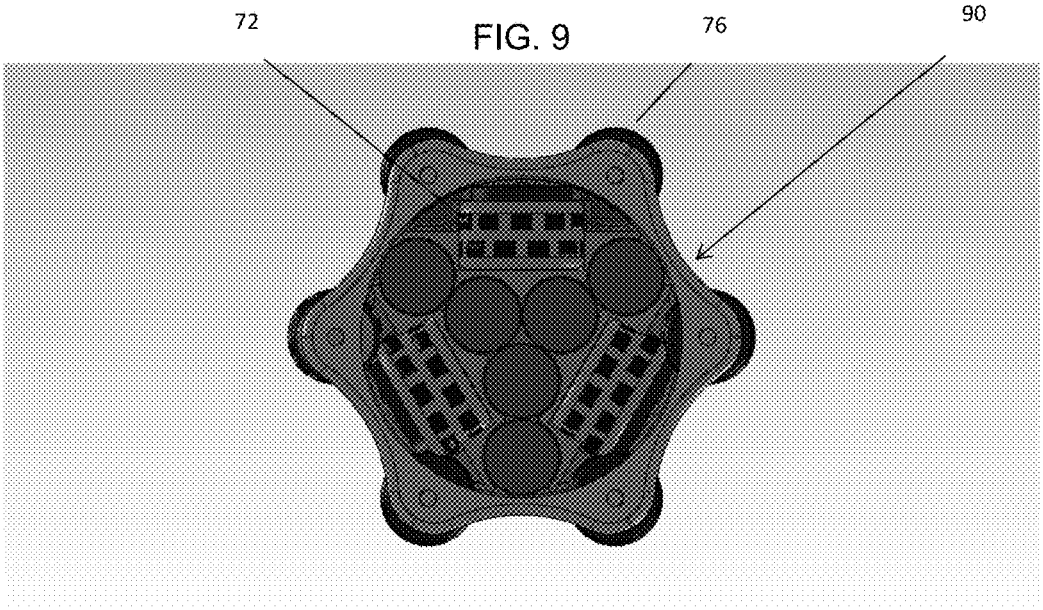
FIG. 10 is a bottom view of the robot shown in FIG. 9.
Figure 11:
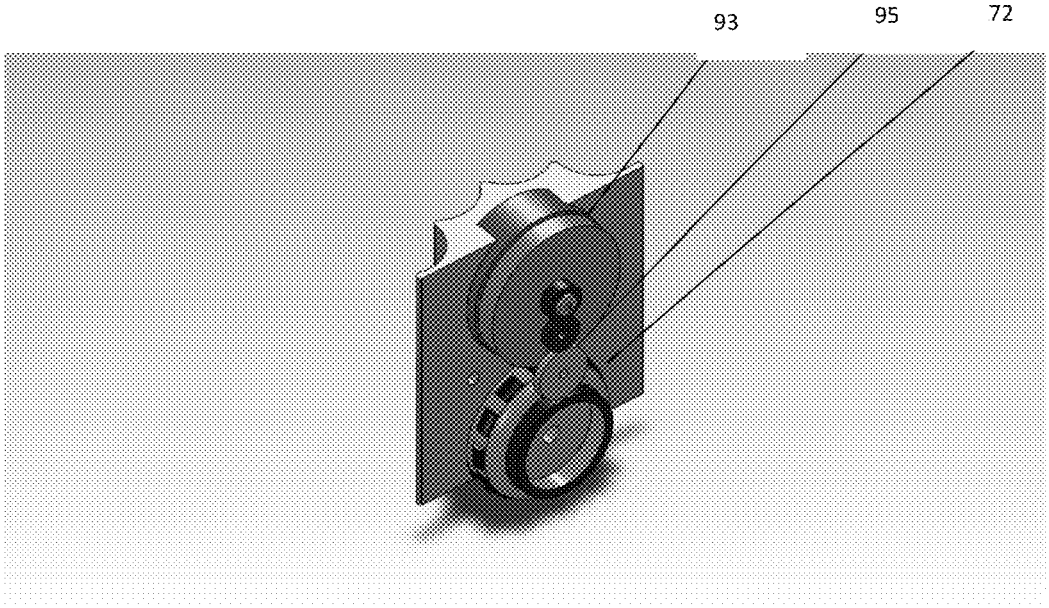
FIG. 11 is a view of the drive system for a wheel of a robot of FIG. 9.

An alternative shape of a robot operative on a playing surface 12, 12', or 50 is shown generally at 90 in FIGS. 9-11, where like numerals have the meaning associated with the aforementioned drawings. Rollers 76 are provided on the exterior in some embodiments to allow for robots to slide relative to other robots or targets 18. A drive system for a wheel 72 is shown in FIG. 11, where a remotely controlled motor 93, operating in both forward and reverse rotational directions is mechanically coupled to the wheel 72 by gearing 95.

In certain embodiments of the present invention, a target identification system may be communication with a central controller or computing device by wireless or wired connection. In other embodiments of the present invention, a display for showing scoring, current status of the pool balls, and other gaming parameters are in communication with a target identification system.

In another embodiment, the robots push targets around and/or release weapons 74, which require targets and robots being confined to a defined play space, with a scoring technique for the targets and weapon's munitions used during play or other scoring technique for assessing a success for a given player.

Game components for a weapons based game include at least one robot—one per person/team. The at least one robot having locomotion and a weapons platform. In some specific embodiments, the robot is a tracked vehicle that functions similar to a military tank. In some embodiments, targets 18 as provided illustratively include a ball, a puck, a can, or a combination thereof. It is further appreciated that games can be played with multiple targets, of like or different size and shape relative to one another to be manipulated as a basis for scoring. A weapon with munitions mounted on at least one of the robot illustratively includes a projectile launcher, a visible light beam, a laser beam, an IR beam, a water cannon, a gas gun, a flame-thrower, a missile, an aircraft, a rocket, an obstacle launcher, fireworks, or combinations thereof. A robot in some embodiments has as a controller a smart phone or tablet device with one player per robot or a second team player acting as a gunner or tactician. The game controller ties the playing surface 12 as defined by the sections, robots and controllers together to score and control the game. In some embodiments, the controller is installed in a section or mat as defined above.

It is appreciated that various games are readily developed based on the robots, targets and playing surfaces as defined herein. These games include:

1. Multiple Robots play a simultaneous pushing game with targets—when the targets associated with a Robot are pushed out of the game (thru a target gate in a Stadium Wall Module), that Robot is disabled from playing the game (shuts down movement) while the other Robots continue to play. Play continues until there is only one Robot with live targets left (the winner!).
2. Multiple Robots play a simultaneous pushing game with targets—the first Robot to push all of its associated targets out of the game (thru a target gate in a Stadium Wall Module), is the winner.
3. Single Robot plays a timed pushing game with targets—when the targets are pushed out of the game (thru a target gate in a Stadium Wall Module), time is recorded—fastest time is the winner.
4. Single or multiple Robots play a timed game in the Stadium touching/hitting/approaching/shooting features (Buttons, Bumpers, Sensors, Opening, target gates, munition gates, etc.) on/in the Stadium Wall Modules using the Robots, targets and munitions.
5. Limit munitions/battery power for a robot, with resupply coming at the cost of objective completion opportunities.
6. Single or multiple Robots play a scoring game in the Stadium touching/hitting/approaching/shooting features (Buttons, Bumpers, Sensors, Openings, target gates, munition gates, etc.) on/in the Stadium Wall Modules using the Robots, targets and munitions—high score is the winner.
7. Single or multiple Robots play a video-like game of sequential challenges.
8. Combinations of the above.

Variations on a bounded playing surface 50 illustratively include:

1. Which, when assembled, enclose the Robots and targets in a defined space for playing games
2. That rest primarily on a horizontal playing surface (Billiards Table, Craps Table, Ping-Pong Table, Floor, Driveway, Table, etc.)
3. With target gates that allow the targets to pass thru a gate section to be scored
4. With target gates that allow the targets to pass thru, said gate section having means to identify targets as they pass through (see target Reading Device below) out of the Game (or to be collected and re-used during game)
5. With target gate sections which have means to automatically close/open (Gates, Doors, Windows, Bars, etc.)
6. With target gate sections which have means to indicate (lights, flags, etc.) if they are open or closed (a closed gate could score negative points)
7. With target gate sections which are different sizes (smaller size scores more points)
8. With target gate sections that physically align to pockets on a Billiard Table (targets could be Pool Balls)
9. With target gate sections that collect/control the targets for other purposes
10. With means to re-introduce the targets to the Game/Stadium for continued play
11. With Buttons and/or Sensors that can be activated by pushing/touching/approaching/shooting with Robots, targets and/or munitions.
12. Which incorporate munition gates, for the Weapons to fire munitions at and score points
13. With munition gates that can distinguish munitions from different Robots
14. With dedicated munition gates that are capable to detect one type of munition (Projectile, Visible Light Beam, Laser Beam, IR Beam, Water, Gas, Flame, Missile, Airplane, Rocket, Firework, etc.)
15. With munition gates that are capable to detect multiple types of munition (Projectile, Visible Light Beam, Laser Beam, IR Beam, Water, Gas, Flame, Missile, Airplane, Rocket, or Firework, etc.)
16. With munition gates at various (adjustable?) angles and sizes to vary difficulty of hitting
17. With Blocks of various size, shape and location to vary difficulty of hitting munition gates
18. With Back-Boards (Mirror, angled Wall, etc.) of various size, shape and location to vary difficulty of hitting munition gates
19. With capability to install other munition gates
20. With Garage feature to store and re-charge Robot(s)
21. With Garage feature including a Door, with Door opening to start Game
22. With Garage feature that acts as a sizing gage for Robots—if it does not fit in the Garage, it is too big to play
23. Which contains a Game Brain (game controller) that is linked to the Robot Controllers (smart phones) and other Stadium Wall Modules for scoring and game control
24. That communicate the status of the target gates, Buttons, Sensors, munition gates, etc. to the Game Brain
25. With Lights for various visual effects
26. With a Scoreboard/Display
27. With Speakers for various sound effects
28. With Microphones for other applications
29. With Cameras (pan, tilt, zoom) for remote viewing by fans
30. With Batteries
31. With Connector for power input
32. With Connector for wire to communicate and/or power with other Wall Modules
33. With Wireless connection
34. With Link feature on each end to enable physically joining a series of Modules
35. With Hinge feature on each end to enable linking Modules together with a Hinge Pin
36. With features (Holes) to enable installation of support beams for a Canopy/Tent
37. With Pads on the bottom for anti-skid and mating surface protection
38. With cosmetic features to mimic Buildings, Arcade Games and Boardwalk Rides (Garage, Fun House, Shooting Gallery, Haunted House, Basketball, Baseball, etc.)
39. With Stands/Seats to display Avatar "Fans" (interface same as in/on the Robots)
40. Which contain no electronics for in-expensively increasing Stadium size
41. Which incorporate standard lumber sizes (1×4, 2×4, etc.)
42. That contain features from all of the above Various methods of target reading are contemplated relative to the position of a gate are provided. These methods illustratively include:

Provide a Vision System (video camera) at each target gate that can view individual targets (Balls) when they pass thru that gate.

Provide a System whereby the Video from each camera can be viewed on a display (locally or remotely) by people (judges) and the people/judges can determine which targets pass through which target gate and at what time during the Game.

Provide Controls for the Judges that give feedback to the Game Brain (diminishing or enhancing robots, scoring points, timing, etc.) based on the circumstances of the game.

Provide a System to record and play back the Video from each target gate for "instant replay" determination of who scores/wins the game. The Video playback could be made available to the players on their smart-phones or to remote judges.

Provide a Time Stamp on each Video which will enable judges to determine the order of finish.

The System could use various technologies for the Transmission of information about the target gates/targets to the game controller such as wire, cell phone, radio, internet, Skype, computer network, Wi-Fi, Bluetooth etc.

A munitions reading device for scoring is also provided in some inventive embodiments. Such devices illustratively include:

Projectile:

1. Provide Projectiles (Balls, Cylinders, Bullets, Missiles, etc.) on the Robots with machine readable (vision) unique Marks or Colors for each Projectile
2. Provide a means on each Robot to fire the Projectile
3. Provide a Vision/Electronic System at each Projectile munition gate that can identify individual Projectiles (Marks or Colors) when they pass thru that gate.
4. Provide a Vision/Electronic System placed on, around, under or above the Stadium that can track and identify individual Projectiles when they pass thru any munition gate
5. Said System could use various technologies to identify the Marks or Colors on the Projectiles such as Vision, OCR, Bar Code Reader, Laser, Color Recognition etc.

6. Provide means to Transmit the information about the Projectiles to the Game Brain such as wire, cell phone, radio, internet, Skype, computer network, Wi-Fi, Bluetooth etc.
7. Score the munition Light Beam:

1. Provide Light Beams on the Robots with different frequencies/colors/pulse-rates for each Robot/Weapon
2. Provide means on each Robot to fire the Light Beam
3. Provide an electronic system at each Light Beam munition gate that can sense and differentiate the different frequencies/colors/pulse-rates of the Light Beam when they hit or pass thru that gate
4. Provide means to Transmit the information about the Light Beams to the Game Brain such as wire, cell phone, radio, internet, Skype, computer network, Wi-Fi, Bluetooth etc.
5. Score the munition Laser Beam:

1. Provide Laser Beams on the Robots with different frequencies/pulse-rates for each Robot/Weapon
2. Provide means on each Robot to fire the Laser Beam
3. Provide an electronic system at each Laser Beam munition gate that can sense and differentiate the different frequencies/pulse-rates of the Laser Beam when they hit or pass thru that gate
4. Provide means to Transmit the information about the Laser Beams to the Game Brain such as wire, cell phone, radio, internet, Skype, computer network, Wi-Fi, Bluetooth etc.
5. Score the munition IR Beam:

1. Provide IR Beams on the Robots with different frequencies/pulse-rates for each Robot/Weapon
2. Provide Means on each Robot to fire the IR Beam
3. Provide an electronic system at each IR Beam munition gate that can sense and differentiate the different frequencies/pulse-rates of the IR Beam when they hit or pass thru that gate
4. Provide means to Transmit the information about the IR Beams to the Game Brain such as wire, cell phone, radio, internet, Skype, computer network, Wi-Fi, Bluetooth etc.
5. Score the munition Water:

1. Provide or produce Water on the Robots with different colors/chemistry for each Robot/Weapon
2. Provide means on each Robot to shoot the Water
3. Provide an electronic system at each Water munition gate that can sense and differentiate the different colors/chemistry of the Water when it hits or passes thru that gate
4. Provide means to Transmit the information about the Water to the Game Brain such as wire, cell phone, radio, internet, Skype, computer network, Wi-Fi, Bluetooth etc.
5. Score the munition Gas Gun:

1. Provide or produce compressed Gas on the Robots with different colors/chemistry for each Robot/Weapon
2. Provide a means on each Robot to shoot the Gas
3. Provide an electronic system at each Gas munition gate that can sense and differentiate the different colors/chemistry of the Gas when it hits or passes thru that gate
4. Provide means to transmit the information about the Gas to the Game Brain such as wire, cell phone, radio, internet, Skype, computer network, Wi-Fi, Bluetooth etc.
5. Score the munition.

Obstacle Layer:

1. Provide obstacles that are dropped onto the playing surface to impede competitive robot
2. Provide a means on each robot to drop the obstacle
3. Provide an electronic system to indicate when a robot contacts an obstacle
4. Provide means to transmit the information about the obstacle contact such as wire, cell phone, radio, internet, Skype, computer network, Wi-Fi, Bluetooth etc.
5. Score the munition Flame:

1. Provide or produce Combustible Fuel for making a Flame on the Robots that produces different colors/chemistry for each Robot/Weapon
2. Provide means on each Robot to ignite and shoot the Fuel/Flame 3. Provide an electronic system at each Flame munition gate that can sense and differentiate the different colors/chemistry of the Fuel/Flame when it hits or passes thru that gate
4. Provide means to Transmit the information about the Fuel/Flame to the Game Brain such as wire, cell phone, radio, internet, Skype, computer network, Wi-Fi, Bluetooth etc.
5. Score the munition Missile:

1. Provide Missiles on the Robots that produces different colors/chemistry/electronic signals for each Robot/Weapon
2. Provide means on each Robot to launch the Missile
3. Provide an electronic system at each Missile munition gate that can sense and differentiate the different colors/chemistry/electronic signals of the Missile when it hits or passes thru that gate
4. Provide means to transmit the information about the Missile to the Game Brain such as wire, cell phone, radio, internet, Skype, computer network, Wi-Fi, Bluetooth etc.
5. Score the munition Airplane:

1. Provide Airplanes on the Robots that produces different colors/electronic signals for each Robot/Weapon
2. Provide means on each Robot to launch the Airplanes
3. Provide an electronic system at each Airplane munition gate that can sense and differentiate the different colors/electronic signals of the Airplane when it hits or passes thru that gate
4. Provide means to Transmit the information about the Airplane to the Game Brain such as wire, cell phone, radio, internet, Skype, computer network, Wi-Fi, Bluetooth etc.
5. Score the munition Rocket:

1. Provide Rockets on the Robots that produces different colors/chemistry/electronic signals for each Robot/Weapon
2. Provide means on each Robot to launch the Rockets
3. Provide an electronic system at each Rocket munition gate that can sense and differentiate the different colors/chemistry/electronic signals of the Rocket when it hits or passes thru that gate
4. Provide means to Transmit the information about the Rocket to the Game Brain such as wire, cell phone, radio, internet, Skype, computer network, Wi-Fi, Bluetooth etc.
5. Score the munition Firework:

1. Provide Fireworks on the Robots that produce different colors/chemistry for each Robot/Weapon
2. Provide means on each Robot to launch the Fireworks
3. Provide an electronic system at each Firework munition gate that can sense and differentiate the different colors/chemistry of the Fireworks when it hits or passes thru that gate
4. Provide means to Transmit the information about the Firework to the Game Brain such as wire, cell phone, radio, internet, Skype, computer network, Wi-Fi, Bluetooth etc.
5. Score the munition In embodiments of the inventive game, the slave targets are electronically intelligent and coupled/matched (owned) to each master robot of each competitor. Furthermore, there can be any number of slaves matched with a single master robot (but the number should be the same for all competing master robots in a single game). When a master robot's slave target is eliminated (or impaired) from the playing field, reduced functionality of the slave owner's master robot can be initiated. Various stages of impaired functionality can be implemented for each slave eliminated. Master robots could display an indication of the number of slaves still "alive" in the game. In embodiments, the game ends when only one master robot has functioning slaves.

Embodiments of the inventive robotic game may be played on a table, pool table, floor or other suitable indoor or outdoor surface (with tape or lines to define the playing field), etc. The object of the game is to push (using the master robot) the opponent's slave targets off the table, into a pocket of a pool table, or out of the demarcated playing field surface. Each player controls one master robot. Each robot can have any number of slave targets.

Embodiments of the master robots in the inventive game may be controlled with a portable electronic device (controller), such as a smart phone, with communication and imaging capabilities, such as a camera. The master robot and slave targets may sync (and link with each other) with the portable electronic device via a bar code, quick response (QR) code, radio frequency identification (RFID), near field communication, Bluetooth, and other identification methods. In an embodiment the barcode may be positioned on the bottom of the robot for scanning or image capture with the portable electronic device. The master robot also may be configured with the ability to sync with the slave targets. The portable electronic device or controller may be configured with software, such as a downloadable application (App) for playing the inventive game. The controller may have inertial sensors to provide a tilt to drive for the robot being controlled i.e.,—more tilt, more speed—horizontal is no speed in any direction. Additional movement control may include "Push to Pass" feature to enable short bursts of speed for the robot. The controlling device may also provide indicators such as a for example a timer to show when the last target was killed—used to decide who wins in close decisions, controls to set the number of targets in a game, a way to connect all controllers in a game so that they can all start the game at the same time. The controller may have display aspects to provide simulated game play to practice the physical game, as well as the ability to control a physical game remotely.

Embodiments of the master robots may be configured with software to keep the robot on the playing field (table), or be user programmable to map the playing field (surface). In addition the master robots may be equipped with sensors to identify the boundaries or edges of the playing field surface. Embodiments of the software for controlling the master robots may also be configured with a victory "dance" and an introductory "dance" routine program. Embodiments of the robot may have omni-wheel drive so that it can move in any direction at any time (no steering).

Embodiments of the master robot may have a power source such as a battery, lights, vision capability with one or more cameras, and audio capability through a speaker. In an embodiment, the vision system may enable viewing (controlling) the game from the robot's perspective. The robot may be configured with a removable crown which can be illuminated from the bottom with multi-colored light(s) from the Robot. Each crown can be unique by using rapid manufacturing. The robot may have an Indicator to show how many targets are still alive, such as multiple lights to indicate how many targets are left.

Embodiments of the slave targets may have electronic intelligence and two-way communication capability with any master robot, and have an ability to "lock" with one individual master robot. Embodiments of the slave target may have a power source such as a battery, lights, vision capability with one or more cameras, and audio capability through a speaker. An example of audio may be a scream when killed. The slave targets may be equipped with sensors to identify the boundaries or edges of the playing field surface. The slave targets may assume a spherical shape (ball) for rolling on playing field surface (pool table).

Embodiments of the slave targets may be configured with a removable "Head" that can fall off during game, thereby initiating some response from the master robot. In an embodiment the head that pops off (spring loaded) when eliminated from game (as it goes off a table, into a pocket, over the line). Furthermore, the head may be configured like the back end of a throwing dart (post) to accommodate the "flights" for identification of the targets.

Embodiments of the slave targets may sync with the portable electronic device via a bar code, quick response (QR) code, radio frequency identification (RFID), near field communication, Bluetooth, and other identification methods. In an embodiment the barcode may be positioned on the bottom of the slave target for scanning with the portable electronic device.

The game field (table, pool table, floor, etc.) may have lines/tape to identify boundaries. In an embodiment the playing surface may be a mat with graphics and indicators for positioning game pieces before play begins (and to protect pool table felt). In embodiments the mat may have Intelligence to monitor game pieces, and/or electronic graphics for visual stimulation of the players and audience. The mat may also be rolled up for easy transport and storage. A video camera may be mounted above the playing surface for implementing: vision system software to track spherical (pool ball) targets going into pockets of pool table; shutting down a master robot when targets are off the playing field; and for broadcasting video of the game so the game can be played remotely and for instant replay. A laser system may be mounted above the pool table for providing indicating lines on pool table for play of cues and balls.

Embodiments for a carrying/shipping/storage/retail/packaging case can have: built-in charging station for the robot(s) and targets; a large battery to support charging; solar panels to support charging; and an electronic tracking device.

Any patents or publications mentioned in this specification are herein incorporated by reference to the same extent as if each individual publication was specifically and individually indicated to be incorporated by reference.

The foregoing description is illustrative of particular embodiments of the invention, but is not meant to be a limitation upon the practice thereof.

The invention claimed is:

1. A robotic gaming system comprising:

a plurality of sensors placed on a de novo playing surface constructed in user selected configurations that are reconfigurable based on modular components of gate and wall sections laterally joined to define the playing surface, at least one of said plurality of sensors present in a gate section;

at least one robot controlled by a player with a smart phone and navigating on the playing surface;

at least one target on the playing surface; and wherein said plurality of sensors are operative for identifying when said at least one target is moved to a scoring region of the playing surface.

2. The system of claim 1 wherein said plurality of sensors are a vision system with character recognition that recognizes a number printed on a surface of said at least one target.

3. The system of claim 2 wherein the said vision system recognizes a machine readable marking on said at least one target.

4. The system of claim 1 wherein said at least one robot is equipped with a weapon.

5. The system of claim 1 wherein said at least one sensor is in communication with a central controller or a computing device by wireless or wired connection.

6. The system of claim 1 wherein the playing surface is a mat embedded with tracking and identification sensors, the mat dimensioned to fit a billiard table playing surface.

7. The system of claim 6 wherein said at least one target is configured with at least one of radio frequency identification (RFID), magnet, or other electronic embedded components.

8. The system of claim 7 wherein said mat is configured to be rolled up.

9. The system of claim 6 further comprising a felt finish without any markings, or may have markings related to a game.

10. A robotic game system comprising:

a plurality of master robots, each of the master robots uniquely assigned to a player;

one or more slave targets uniquely assigned to each of the master robots;

a smart phone controller assigned to each player for interactive control of an assigned master robot and corresponding slave targets;

a de novo playing surface constructed in user selected configurations that are reconfigurable based on modular components of gate and wall sections laterally joined to define the playing surface, at least one of said plurality of sensors present in a gate section; and wherein the game concludes when all of the slave targets of competing players have been eliminated from the playing surface.

11. The system of claim 10 wherein said at least one robot is equipped with a weapon.

12. The system of claim 10 wherein said at least one sensor is in communication with a central controller or a computing device by wireless or wired connection.

13. The system of claim 10 wherein the playing surface is a mat embedded with tracking and identification sensors, the mat dimensioned to fit a billiard table playing surface.

14. The system of claim 13 wherein said at least one target is configured with at least one of radio frequency identification (RFID), magnet, or other electronic embedded components.

15. The system of claim 13 further comprising a felt finish without any markings, or may have markings related to a game, such as a robotic game with graphics and indicators for positioning a set of game pieces before play begins.

16. The system of claim 15 wherein said mat is configured to be rolled up for easy transport and storage.

17. A process for playing a robotic game comprising:

electronically coupling at least one first competitor slave target, each of the at least one first competitor slave target having intelligence to a first competitor master robot with a first smart phone controller;

electronically coupling at least one second competitor slave target, each of the at least one second competitor slave target having intelligence to a second competitor master robot with a second smart phone controller;

placing the at least one first competitor slave target, the at least one second competitor, the first competitor master robot, and the second competitor master robot onto a de novo playing field constructed in user selected configurations that are reconfigurable based on modular components of gate and wall sections laterally joined to define the playing surface, at least one of said plurality of sensors present in a gate section; and reducing or eliminating functionality of the first competitor master robot when the at least one first competitor slave target is removed from the playing field alone or in combination with reducing or eliminating functionality of the second competitor master robot when the at least one second competitor slave target is removed from the playing field.

* * * * *